US008147186B2

(12) United States Patent
Ibaraki et al.

(10) Patent No.: US 8,147,186 B2
(45) Date of Patent: Apr. 3, 2012

(54) CENTRIFUGAL COMPRESSOR

(75) Inventors: Seiichi Ibaraki, Nagasaki (JP); Isao Tomita, Nagasaki (JP); Yasuaki Jinnai, Sagamihara (JP); Takashi Shiraishi, Sagamihara (JP); Koichi Sugimoto, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 247 days.

(21) Appl. No.: 12/308,246

(22) PCT Filed: Apr. 10, 2008

(86) PCT No.: PCT/JP2008/057077

§ 371 (c)(1),
(2), (4) Date: Dec. 11, 2008

(87) PCT Pub. No.: WO2008/129953

PCT Pub. Date: Oct. 30, 2008

(65) Prior Publication Data

US 2010/0166539 A1 Jul. 1, 2010

(30) Foreign Application Priority Data

Apr. 20, 2007 (JP) ..... 2007-111748

(51) Int. Cl.
*F01D 9/04* (2006.01)

(52) U.S. Cl. ..... 415/148; 415/208.3; 415/211.1; 415/211.2

(58) Field of Classification Search ..... 415/148, 415/150, 208.2, 208.3, 208.4, 211.1, 211.2
See application file for complete search history.

(56) References Cited

U.S. PATENT DOCUMENTS 3,829,235 A * 8/1974 Woollenweber, Jr. ..... 415/143

(Continued)

FOREIGN PATENT DOCUMENTS

JP 60-184998 9/1985

(Continued)

OTHER PUBLICATIONS

International Search Report issued May 20, 2008 in the International (PCT) Application of which the present application is the U.S. National Stage.

*Primary Examiner* — Benjamin Sandvik
*Assistant Examiner* — Krista Soderholm
(74) *Attorney, Agent, or Firm* — Wenderoth, Lind & Ponack, L.L.P.

(57) ABSTRACT

A centrifugal compressor having a wide operating range, being economically efficient and high reliability in terms of a stable operation is provided. A centrifugal compressor including a partition wall for dividing a flow channel in the diffuser section and the volute section into a plurality of channels in the direction of circulation of the fluid so as to define a hub-side flow channel and a shroud-side flow channel; and a flow rate adjusting valve for lowering the flow rate of the fluid flowing in the shroud-side flow channel to increase the flow rate in the hub-side flow channel when the flow rate of the fluid compressed by an impeller is low and not lowering the flow rate of the fluid flowing the shroud-side flow channel to allow the fluid to flow both in the shroud-side flow channel and the hub-side flow channel when the flow rate of the fluid compressed by the impeller is high is employed.

7 Claims, 15 Drawing Sheets

U.S. PATENT DOCUMENTS

| | | | | |
|---|---|---|---|---|
| 4,626,168 | A * | 12/1986 | Osborne et al. | 415/208.3 |
| 4,643,639 | A * | 2/1987 | Caine | 415/148 |
| 6,250,882 | B1 * | 6/2001 | Nagashima | 415/204 |
| 6,651,431 | B1 * | 11/2003 | Yang et al. | 60/605.1 |

FOREIGN PATENT DOCUMENTS

| | | |
|---|---|---|
| JP | 61-76798 | 4/1986 |
| JP | 62-126600 | 8/1987 |
| JP | 10-176699 | 6/1998 |
| JP | 11-173300 | 6/1999 |
| JP | 3038398 | 5/2000 |
| JP | 2001-329995 | 11/2001 |
| JP | 2001-329996 | 11/2001 |
| JP | 2005-194933 | 7/2005 |

* cited by examiner

CENTRIFUGAL COMPRESSOR

BACKGROUND OF THE INVENTION

I. Technical Field

The present invention relates to a centrifugal compressor used for a turbocharger or the like.

II. Description of the Related Art

In the related art, for example, a centrifugal compressor used for a turbocharger or the like of an internal combustion engine for motor vehicles is known.

FIG. 13 is a front view of a principle portion of a centrifugal compressor in the related art. FIG. 14 is a vertical cross-sectional view of a principal portion of the centrifugal compressor in the related art. A centrifugal compressor 10 in the drawing compresses fluid such as gas or air introduced from the outside of a casing 11 by rotating an impeller 13 provided with a number of blades 12 in the casing 11. The flow of fluid (air flow) formed in this manner is sent to the outside via an impeller exit (hereinafter, referred also to as "diffuser section inlet") 14 which corresponds to the outer peripheral end of the impeller 13, a diffuser section 15 and a volute section 16. Reference numeral 17 in the drawing designates an axis of rotation of the impeller 13.

The diffuser section 15 described above is provided between the impeller exit 14 and the volute section 16, and is a channel for restoring the static pressure by decreasing the velocity of the air flow discharged from the impeller exit 14. The diffuser section 15 is provided with vanes when required. With the provision of the vanes on the diffuser section 15, as shown in FIG. 15, changing of the operating range of the centrifugal compressor is enabled. In other words, with the vanes provided on the diffuser section 15, a surge line which indicates occurrence of surging may be moved at a high-pressure ratio and the side of the low flow rate. Here, the term surging means a phenomenon such that the pressure and the flow rate are varied when the centrifugal compressor generates a sort of self-excited oscillation and discharges compressed air in specific cycles, which determines the operational limit on the side of the low flow rate.

The centrifugal compressor used for the turbocharger for motor vehicles is operated in various numbers of revolutions, a wide operating range is required. However, when the flow rate is lowered in the centrifugal compressor, the above-described surging occurs in the diffuser section 15. On the other hand, when the flow rate is increased, occlusion of fluid, so-called "chocking" occurs at the impeller or in the interior of the diffuser section, and the range of the flow rate on the side of the high flow rate is limited.

In the related art, in order to widen the operating range of the centrifugal compressor, a technology to provide a groove 25 and a circulating channel 26 on a casing 21 is known as shown in FIG. 16 (For example, refer to Japanese Unexamined Patent Application Publication No. Hei 10-176699).

A technology to widen the operating range by applying a variable mechanism such as an inlet variable guide wing or a variable diffuser to the centrifugal compressor is known (For example, refer to Japanese Unexamined Patent Application Publication No. Hei 11-173300, Japanese Unexamined Patent Application Publication No.2001-329995, Japanese Unexamined Patent Application Publication No.2001-329996, and Patent No.3038398). More specifically, the variable diffuser is able to vary the channel area by rotating or sliding a diffuser vane 28 as shown in FIG. 17A and FIG. 17B, and is able to widen the operating range of the centrifugal compressor. In particular, in the variable diffuser in FIG. 17B, the operating range is widened by varying the angle of the diffuser vanes according to the flow velocity of gas discharged from the impeller 13.

SUMMARY OF THE INVENTION

However, the technology disclosed in Japanese Unexamined Patent Application Publication No. Hei 10-176699 has a problem such that a significant improvement cannot be expected although the operating range of the centrifugal compressor is somewhat widened by casing treatment as shown in FIG. 18. The technologies disclosed in Japanese Unexamined Patent Application Publication No. Hei 11-173300, Japanese Unexamined Patent Application Publication No.2001-329995, Japanese Unexamined Patent Application Publication No.2001-329996, and Patent No.3038398have a problem of being economically inefficient because the variable diffuser requires a complicated drive mechanism. Furthermore, since a sliding portion is provided between the diffuser vane 28 and the wall of the diffuser section 15, there are problems such that reliability for a stable operation is low, and gas leakage from a gap at the sliding portion, which deteriorates the performance.

In view of such circumstances, it is an object of the invention is to provide a centrifugal compressor having a wide operating range, being economically efficient and high reliability in terms of a stable operation.

In order to solve the above described problems, following measures are employed.

The centrifugal compressor according to the invention is a centrifugal compressor having a rotating shaft, an impeller mounted to the rotating shaft, a casing for housing the impeller, a diffuser section connected to the downstream of the impeller, and a volute section connected to the downstream of the diffuser section for compressing fluid by applying a centrifugal force to the fluid by rotating the impeller, including: a parting member for dividing a flow channel in the diffuser section and the volute section into a plurality of channels in the direction of circulation of the fluid so as to define a hub-side flow channel and a shroud-side flow channel; and a flow rate adjuster for lowering the flow rate of the fluid flowing in a shroud-side flow channel and allowing the fluid to flow in a hub-side flow channel at a high flow rate when the flow rate of the fluid compressed by the impeller is low and not lowering the flow rate of the fluid flowing the shroud-side flow channel to allow the fluid to flow both in the shroud-side flow channel and the hub-side flow channel when the flow rate of the fluid compressed by the impeller is high.

In the centrifugal compressor, the fluid compressed by the impeller has a large flow velocity distribution on the hub-side at an impeller exit. The flow velocity distribution is remarkable when the flow rate is low. Therefore, there is provided the flow rate adjuster for lowering the flow rate of the fluid flowing in the shroud-side flow channel and allowing the fluid to flow in the hub-side flow channel when the flow rate of the fluid compressed by the impeller is low. Accordingly, a small exit flow channel is formed to introduce a large amount of fluid to the hub-side flow channel when the flow rate is low, so that occurrence of surging which indicates the operational limit on the side of the low flow rate is prevented. In contrast, when the flow rate of the fluid compressed by the impeller is high, the fluid is allowed to flow both in the shroud-side flow channel and the hub-side flow channel by the flow rate adjuster. Accordingly, a large exit flow channel is formed to prevent occurrence of chocking which indicates the operational limit on the side of the high flow rate. In this manner, a wide operating range is secured by preventing the occurrence of surging and chocking.

According to the centrifugal compressor in the invention, the wide operating range is achieved in comparison with a variable diffuser which requires a complicated drive mechanism at a low cost. Furthermore, since the number of components which constitutes a drive unit may be reduced, an operation with high reliability is enabled. In addition, since gas leakage from a gap at a sliding portion like the variable diffuser does not occur, lowering of the performance in association with the gas leakage is prevented.

Preferably, the parting member in the centrifugal compressor is a partition wall provided in the interiors of the diffuser section and the volute section.

According to the centrifugal compressor as described above, what is necessary is just to divide the flow channel with the partition wall, division of the flow channels of the diffuser section and the volute section is achieved easily at a low cost.

Preferably, the flow rate adjuster in the centrifugal compressor is a flow rate adjusting valve provided in the vicinity of an exit portion of the volute section.

According to the centrifugal compressor as described above, since the flow rate of the fluid circulating in the respective flow channels is adjusted stably, the wide operating range is secured while preventing occurrence of surging and chocking.

The flow rate adjusting valve is preferably provided in the shroud-side flow channel. In this case, the shroud-side flow channel is fully closed when the flow rate is low, and fully opened when the flow rate is high. When the flow rate is an intermediate flow rate which is the middle between the low flow rate and the high flow rate, the opening of the shroud-side flow channel may be an intermediate opening between the fully closed state and the fully opened state.

Preferably the diameter of at least one of the diffuser section inlets in the centrifugal compressor is 1.02 to 1.2 times the diameter of the impeller.

When the diameter of the diffuser section inlet is smaller than 1.02 times the diameter of the impeller, the partition wall and the flow at the impeller exit interfere with each other and hence the performance is lowered. When the diameter of the diffuser section inlet exceeds 1.2 times the diameter of the impeller, the restoration of the pressure by the diffuser is lowered. Therefore, the diameter of the diffuser section inlet is set to 1.02 to 1.2 times the diameter of the impeller.

Preferably, an end surface of the partition wall on the upstream side is inclined from the hub side to the shroud side.

The flow velocity distribution of the fluid discharged from the impeller is not symmetry on the shroud side and the hub side, and is inclined toward the hub side. Therefore, the end surface of the partition wall on the upstream side is set to a shape inclining from the hub side to the shroud side. Accordingly, separation on the end surface of the partition wall is prevented so that a smooth flow is secured.

Preferably, at least one of diffuser sections in the centrifugal compressor is provided with a vane.

According to the centrifugal compressor as described above, when the flow rate of the fluid is low, a high pressure ratio is obtained by allowing the fluid to circulate in the diffuser section with the vane, which is provided with the vane, so that the occurrence of surging is prevented. When the flow rate of the fluid is high, the occurrence of the chocking is prevented by operating the flow rate adjuster to allow the fluid to flow also through the diffuser section without the vane. Therefore, in this configuration, the wide operating range is secured without causing the surging or the chocking. Since the diffuser section with the vane does not have the sliding portion and hence the gas leakage from the gap does not occur, so that the lowering of the performance in association with the gas leakage does not occur.

Preferably, the cross-sectional area of the flow channel of the diffuser section with the vane in the centrifugal compressor is set to be smaller than the cross-sectional areas of the flow channels of other diffuser sections.

With the centrifugal compressor as described above, since a high pressure ratio is obtained by allowing the fluid to circulate in the diffuser section with the vane when the flow rate of the fluid is low, the operating range may be widened.

According to the centrifugal compressor in the invention, since the flow channels of the diffuser section and the volute section are divided into the hub-side flow channels and the shroud-side flow channels, so that the respective flow channels are used properly depending on the flow rate of the fluid discharged from the impeller, the low-cost and wide operating range is achieved. Also, since a movable portion may be reduced in comparison with the variable diffuser, a centrifugal compressor with a high reliability may be provided.

DETAILED DESCRIPTION OF THE INVENTION

First Embodiment

Figure 1A:
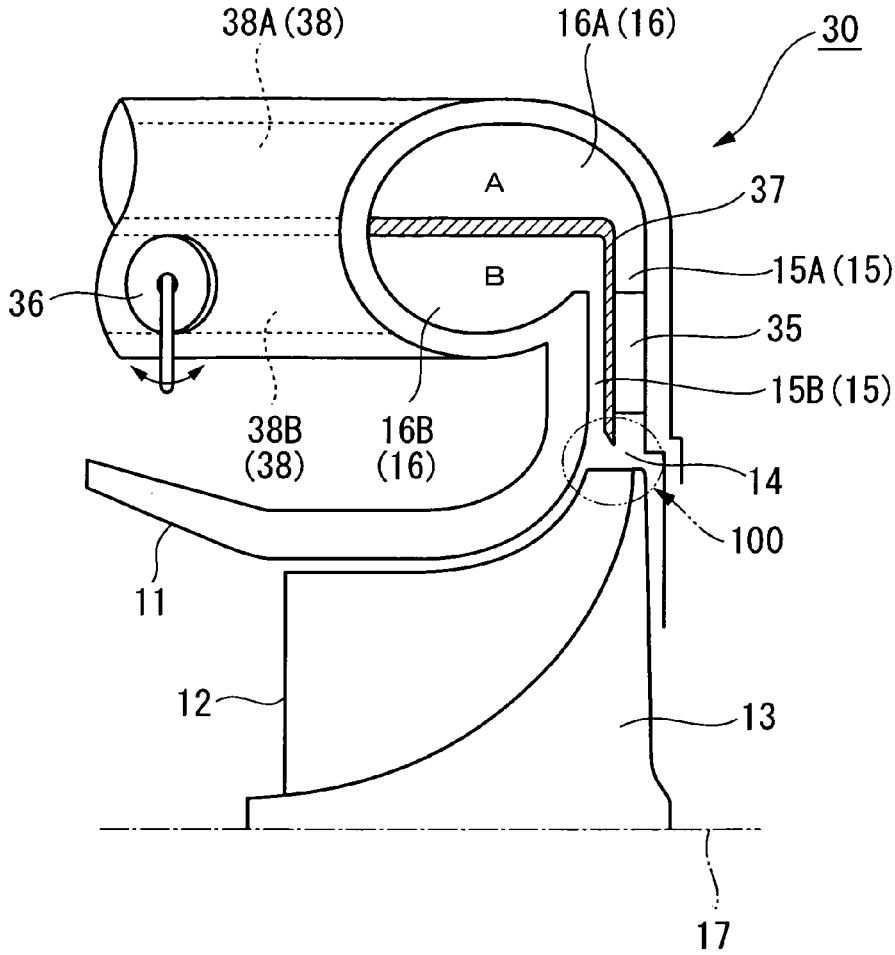
FIG. 1A is a vertical cross-sectional view of a centrifugal compressor according to a first embodiment of the invention.

Referring now to the drawings, a first embodiment of the invention will be described.

Figure 1B:
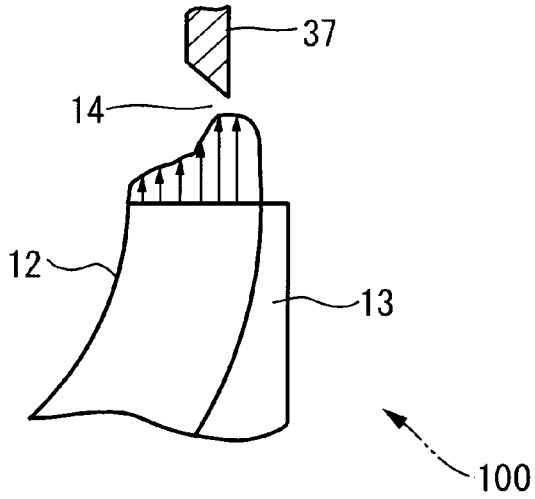
FIG. 1B is a partly enlarged view of an impeller exit of the centrifugal compressor shown in FIG. 1A.

FIG. 1A shows a vertical cross-sectional view of a centrifugal compressor 30 according to the first embodiment. FIG. 1B shows a flow velocity distribution at the time of discharge from an impeller.

In FIG. 1A, the centrifugal compressor 30 includes an impeller 13 having a plurality of blades 12 and a casing 11 for housing the impeller 13.

The impeller 13 is rotated about an axis of rotation 17 by a drive assembly such as a motor or a turbine, not shown. The impeller 13 includes a diffuser section 15 and a volute section 16 on the discharge side of the impeller 13 provided continuously.

The diffuser section 15 reduces the velocity of air flow discharged from the outer peripheral end of the impeller 13 which rotates in the casing 11 and recovers a static pressure.

The volute section 16 is connected to the diffuser section 15 on the downstream side and is provided with a convoluted flow channel. Provided on the downstream side of the volute section 16 is an exit tube 38 for allowing flow of fluid passed through the volute section 16.

In the interiors of the diffuser section 15, volute section 16 and the exit tube 38, a partition wall 37 (parting member) which divides the flow channel into halves in the direction of circulation of the fluid is provided, so that a hub-side flow channel (flow channel A) and a shroud-side flow channel (flow channel B) are formed. Fluid discharged from the impeller 13 toward the hub (right side in the drawing) is introduced into the hub-side flow channel, and fluid discharged from the impeller 13 toward the shroud (left side in the drawing) is introduced into the shroud-side flow channel.

The partition wall 37 is formed of a thin plate, and the cross-sectional area of the diffuser section 15 is expanded by an extent corresponding to the partition wall 37. With such the partition wall 37, the flow channels of the diffuser section 15 and the volute section 16 are divided easily at a low cost.

A hub-side diffuser section 15A is provided with vanes 35. The plurality of vanes 35 are provided circumferentially at predetermined distances, and are fixed to the casing. In other words, the angle of the vanes 35 with respect to the fluid is fixed. The cross-sectional area of the flow channel of a shroud-side diffuser section 15B is larger than the cross-sectional area (throat area) of the flow channel of the hub-side diffuser section 15A. It is for widening the operating range when the flow rate is high. More specifically, the value $S_A/R_A$ is preferably set to be smaller than $S_B/R_B$, where $S_A$ is the lateral cross-sectional area of a hub-side volute section 16A, $R_A$ is a distance from the center of the hub-side volute section 16A (the center of the lateral cross-section) to the axis of rotation 17, $S_B$ is the lateral cross-sectional area of a shroud-side volute section 16B, and $R_B$ is a distance from the center of the shroud-side volute section 16B (the center of the lateral cross-section) to the axis of rotation 17.

A flow rate adjusting valve (flow rate adjuster) 36 for adjusting the flow rates of the respective flow channels is provided in a shroud-side exit tube 38B. In the first embodiment, a butterfly valve is employed as the flow rate adjusting valve 36. By employing the flow rate adjusting valve 36 as the flow rate adjuster, adjustment of the flow rates of the respective flow channels stably with a high degree of accuracy is enabled. The flow rate adjusting valve 36 is preferably installed at a position as close to the volute section 16 as possible in order to reduce the dead capacity.

Figure 2:
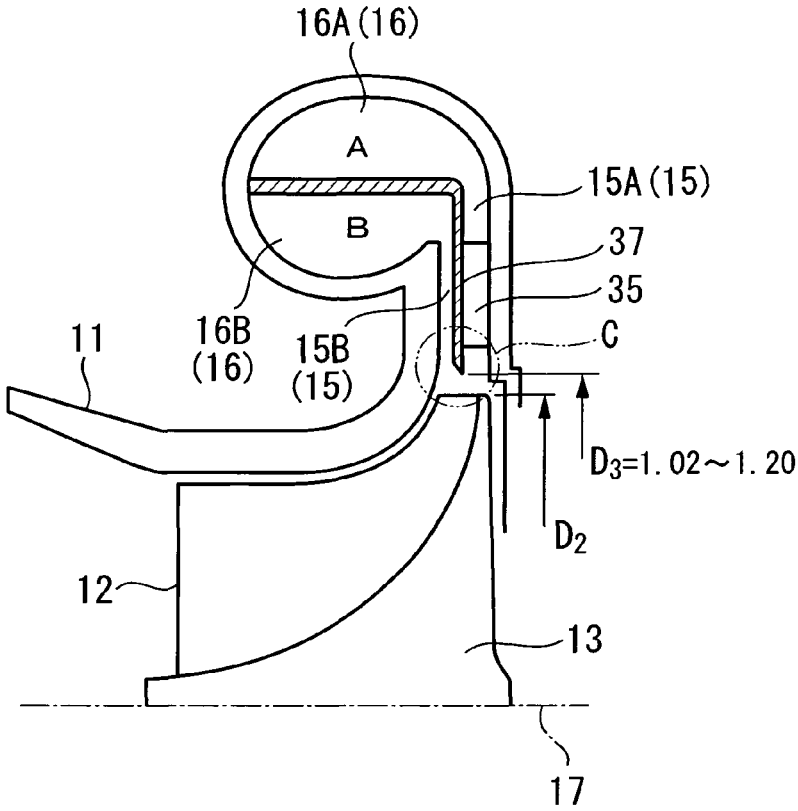
FIG. 2 is a vertical cross-sectional view showing a principal portion of the centrifugal compressor shown in FIG. 1 A.

As shown in FIG. 2, the diameter of a diffuser section inlet 14 is set to 1.02 to 1.2 times the outer diameter of the impeller 13.

Figure 3A:
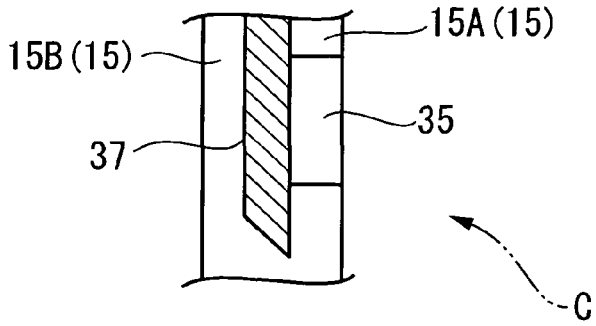
FIG. 3A is a partly enlarged view of a partitioning wall portion of the centrifugal compressor shown in FIG. 2.

As shown in FIG. 3A, the end surface of the partition wall 37 on the upstream side is inclined from the hub side to the shroud side. It is for introducing the fluid uniformly to the hub-side flow channel A and the shroud-side flow channel B when the flow rate of the fluid is high.

Figure 3B:
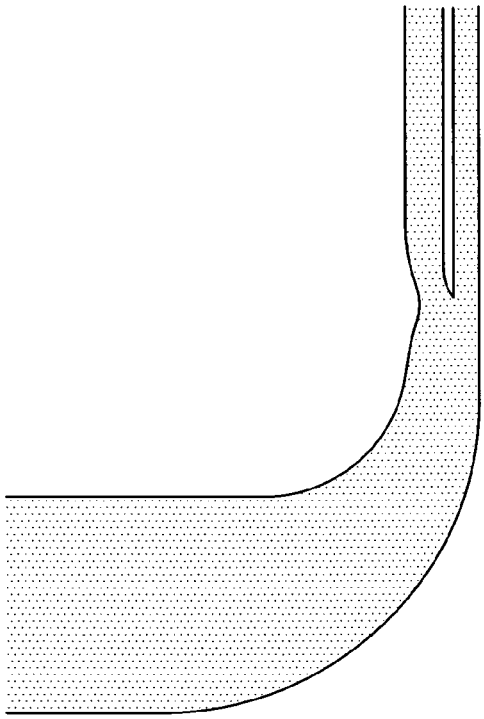
FIG. 3B is an explanatory drawing illustrating a flowing state in the centrifugal compressor shown in FIG. 2.
Figure 3C:
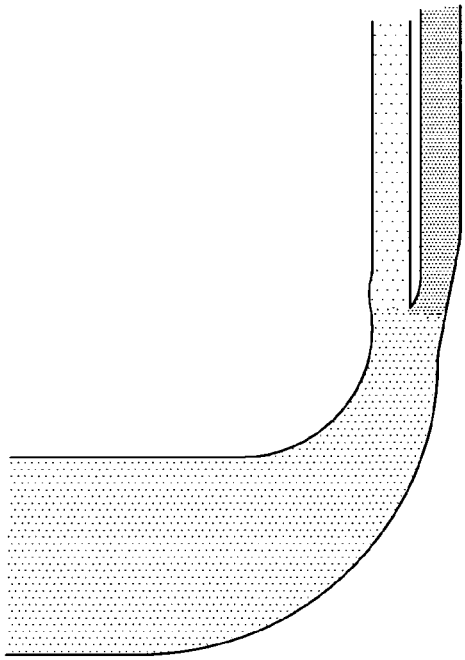
FIG. 3C is an explanatory drawing illustrating a flowing state in a centrifugal compressor in the related art.

Here, results of confirmation of the flowing state due to the difference in direction of inclination of the partition wall by CFD are shown in FIG. 3B and FIG. 3C. FIG. 3B shows a case in which the partition wall is inclined from the hub side to the shroud side as shown in FIG. 3A, and the fluid is uniformly distributed to the hub-side flow channel A and the shroud-side flow channel B. On the other hand, as shown in FIG. 3C, in a case in which the partition wall is inclined from the shroud side to the hub side, the fluid is leaned on the hub side. Therefore, in the first embodiment, the partition wall having a tip in the form shown in FIG. 3A is employed.

The operation of the centrifugal compressor 30 having the configuration described above will be described.

The centrifugal compressor 30 drives the impeller 13 to rotate about the axis of rotation 17 by the drive assembly such as the motor or the turbine, not shown. When the impeller 13 rotates, the fluid taken through an air supply port, not shown, is introduced into the casing 11. The fluid introduced into the casing 11 is applied with a centrifugal force by the rotation of the impeller 13 and hence is compressed, passes through the diffuser section inlet 14, the diffuser section 15, the volute section 16 and the exit tube 38 in this order, and is discharged as a compressed fluid through a discharge port, not shown.

During operation, the flow rates in the respective flow channels are adjusted by operating the flow rate adjusting valve 36.

Figure 4A:
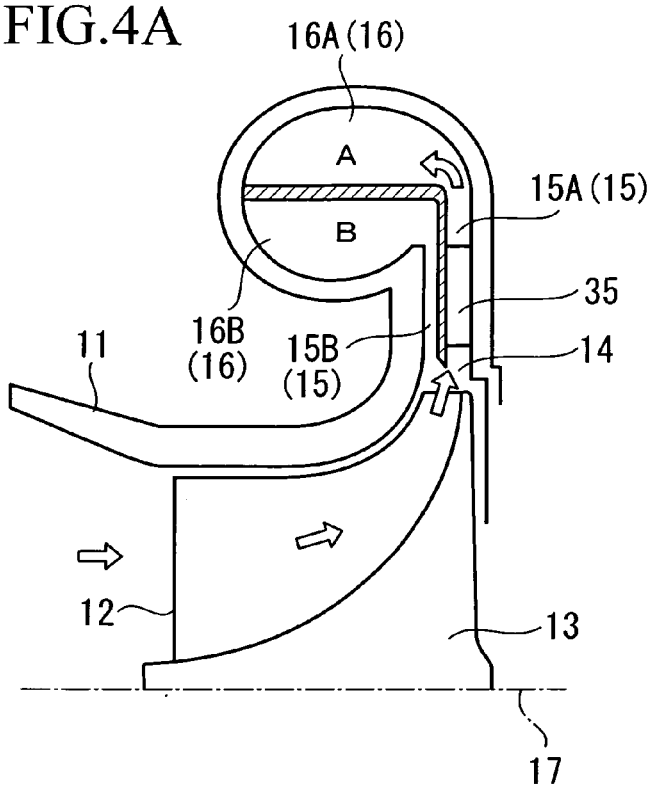
FIG. 4A is a vertical cross-sectional view showing a flowing state of fluid when the flow rate is low in the centrifugal compressor shown in FIG. 2.

When the flow rate of the fluid compressed by the impeller 13 is low, the opening of the flow rate adjusting valve 36 is narrowed to lower the flow rate of the fluid flowing into the shroud-side flow channel B as shown in FIG. 4A, so that the fluid flows in the hub-side flow channel A at a higher flow rate. In other words, the compressed fluid circulates through the diffuser section inlet 14, the diffuser section 15A with the vanes 35, and the volute section 16A in this order.

Figure 4B:
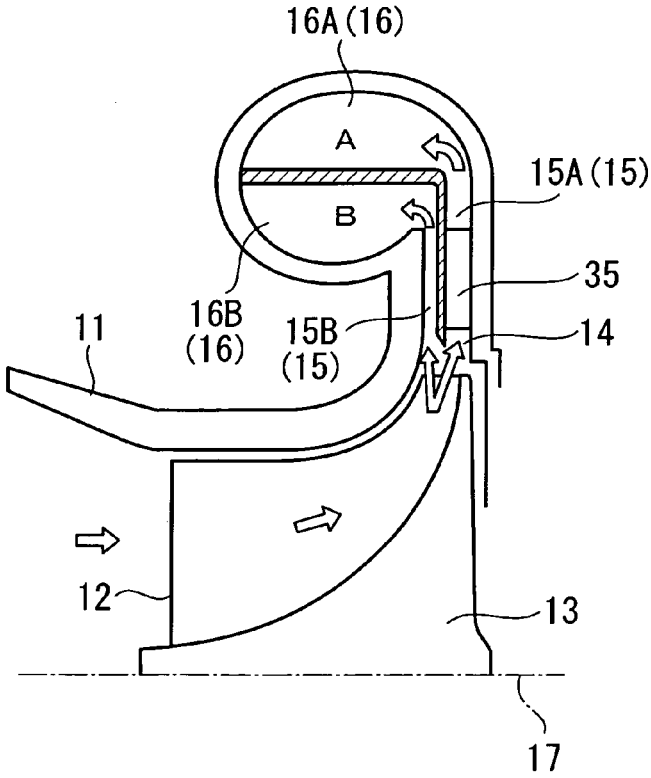
FIG. 4B is a vertical cross-sectional view showing a flowing state of the fluid when the flow rate is high in the centrifugal compressor shown in FIG. 2.

In contrast, when the flow rate of the fluid compressed by the impeller 13 is high, the opening of the flow rate adjusting valve 36 is increased to allow the fluid to flow in the shroud-side flow channel B and the hub-side flow channel A without lowering the flow rate of the fluid flowing in the shroud-side flow channel B as shown in FIG. 4B. In other words, the compressed fluid is branched at the diffuser section inlet 14, and circulates in the flow channel from the diffuser section 15A with the vanes 35 to the volute section 16A and the flow channel from the diffuser section 15B without the vane to the volute section 16B.

In this case, the opening of the flow rate adjusting valve 36 do not have to be fully open and fully close, but preferably can be adjusted to an intermediate opening so that a high pressure ratio is achieved with respect to the flow rate of the compressed fluid.

Figure 5:
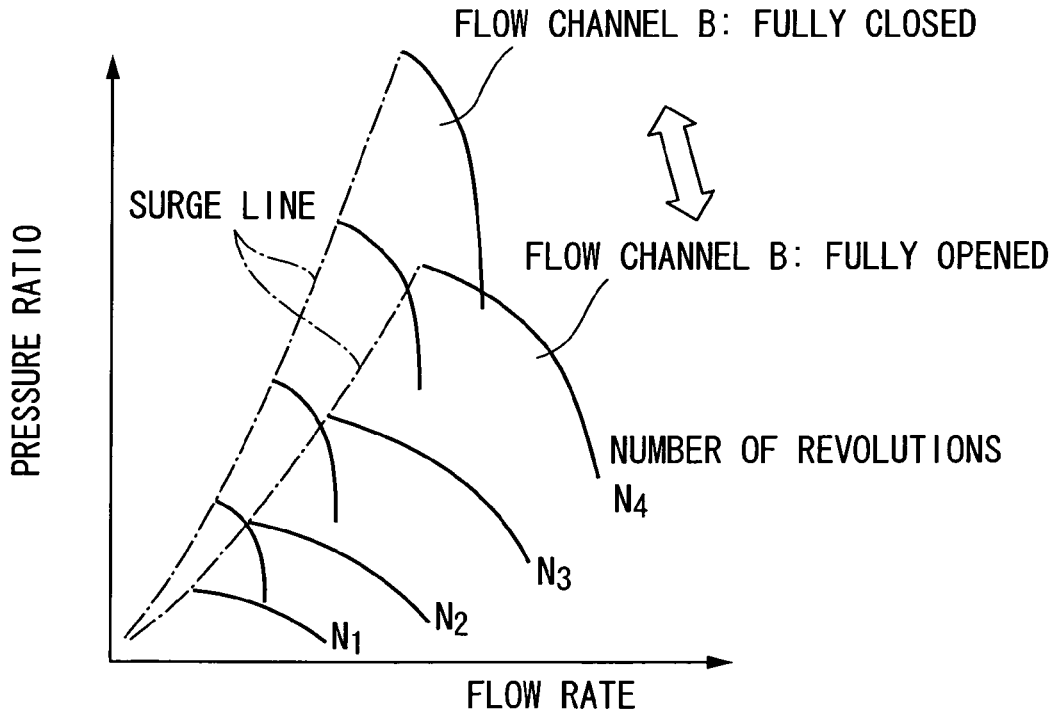
FIG. 5 is a graph showing a relation between the pressure ratio and the flow rate in the centrifugal compressor shown in FIG. 2.

FIG. 5 shows the relation between the flow rate and the pressure ratio of the centrifugal compressor according to the first embodiment.

As is understood from FIG. 5, a high pressure ratio is achieved by lowering the flow rate of the fluid flowing in the shroud-side flow channel B and allowing the fluid to flow in the hub-side flow channel A at a high flow rate when the flow rate of the compressed fluid is low. In other words, the surge line moves to the side of the low flow rate and high pressure ratio. It is also understood that when the flow rate of the compressed fluid is high, a high flow rate is also accommodated by allowing the fluid to flow in the shroud-side flow channel B and the hub-side flow channel A without lowering the flow rate of the fluid flowing in the shroud-side flow channel B.

In the centrifugal compressor, the fluid compressed by the impeller assumes a large flow velocity distribution on the hub side at the impeller exit by the centrifugal force. Therefore, the flow rate adjusting valve 36 is provided in the shroud-side flow channel B, so that the flow rate of the fluid flowing in the shroud-side flow channel B is lowered and that in the hub-side flow channel A is increased when the flow rate of the fluid compressed by the impeller 13 is low by the operation of the flow rate adjusting valve 36. Accordingly, a small exit flow channel is formed, and hence a large amount of fluid is introduced into the hub-side flow channel A when the flow rate is low, so that occurrence of surging is prevented.

In contrast, when the flow rate of the fluid compressed by the impeller 13 is high, the fluid is allowed to flow both in the shroud-side flow channel B and the hub-side flow channel A without lowering the flow rate of the fluid flowing in the shroud-side flow channel B by the operation of the flow rate adjusting valve 36. Accordingly, a large exit flow channel is formed so that occurrence of chocking is prevented.

In this manner, by using only the hub-side flow channel A when the flow rate is low and using the hub-side flow channel A and the shroud-side flow channel B when the flow rate is high, the occurrence of surging and chocking is prevented and the wide operating range is secured.

As described above, according to the centrifugal compressor in the first embodiment, the occurrence of surging and chocking is prevented easily in comparison with the variable diffuser which requires a complicated drive mechanism and a wide operating range is achieved. In addition, since the number of components of a drive unit is reduced, so that the operation with high reliability is enabled. Also, the lowering of the performance due to the gas leakage from a gap at a sliding portion is prevented.

Figure 6A:
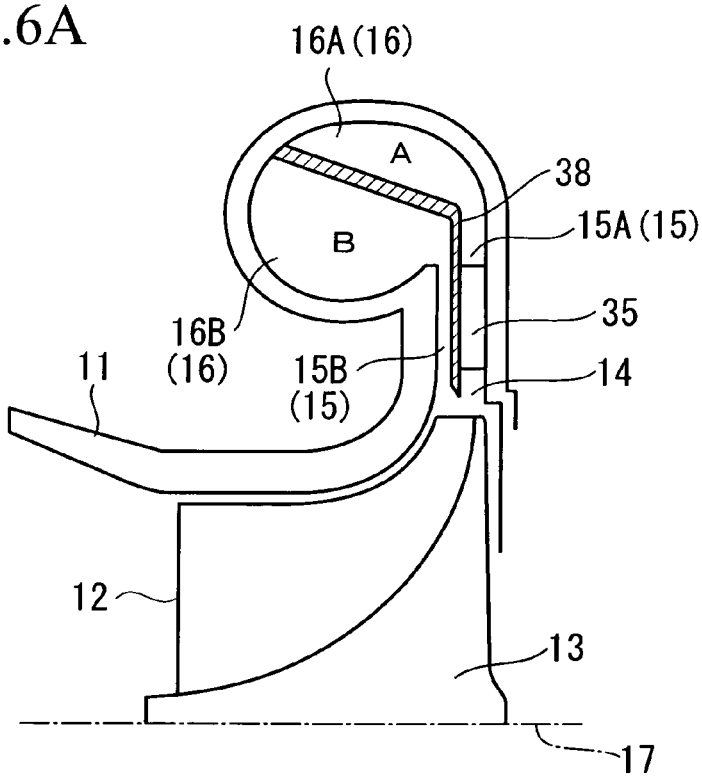
FIG. 6A is a vertical cross-sectional view showing a modification of the centrifugal compressor shown in FIG. 2.
Figure 6B:
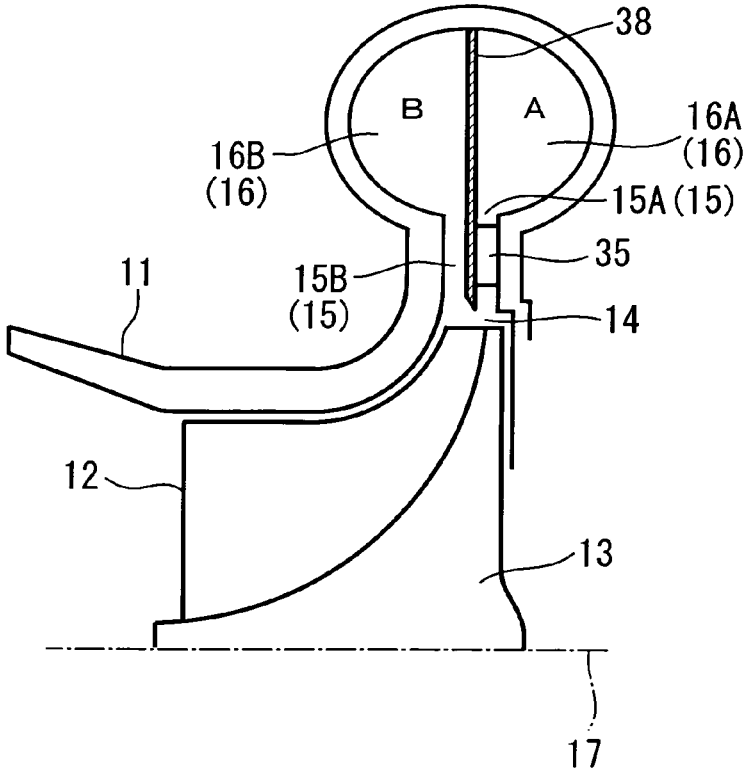
FIG. 6B is a vertical cross-sectional view showing a modification of the centrifugal compressor shown in FIG. 2.

As shown in FIG. 6A and FIG. 6B, the partition wall 37 which divides the diffuser section 15 and the volute section 16 into halves may be provided in the direction inclined with respect to the axis of rotation 17 or may be provided at a right angle.

It is also possible to provide a wall member (not shown) which is removably insertable into the diffuser section 15B instead of the flow rate adjusting valve 36 so as to be able to adjust the flow rate in the shroud-side flow channel B and the hub-side flow channel A.

Although the configuration in which the vanes 35 are provided only on the hub-side diffuser section 15A is exemplified in the first embodiment, a configuration in which the vanes are provided only on the shroud-side diffuser section 15B is also applicable. In this configuration, widening of the operating range of the centrifugal compressor is achieved.

Second Embodiment

Figure 7:
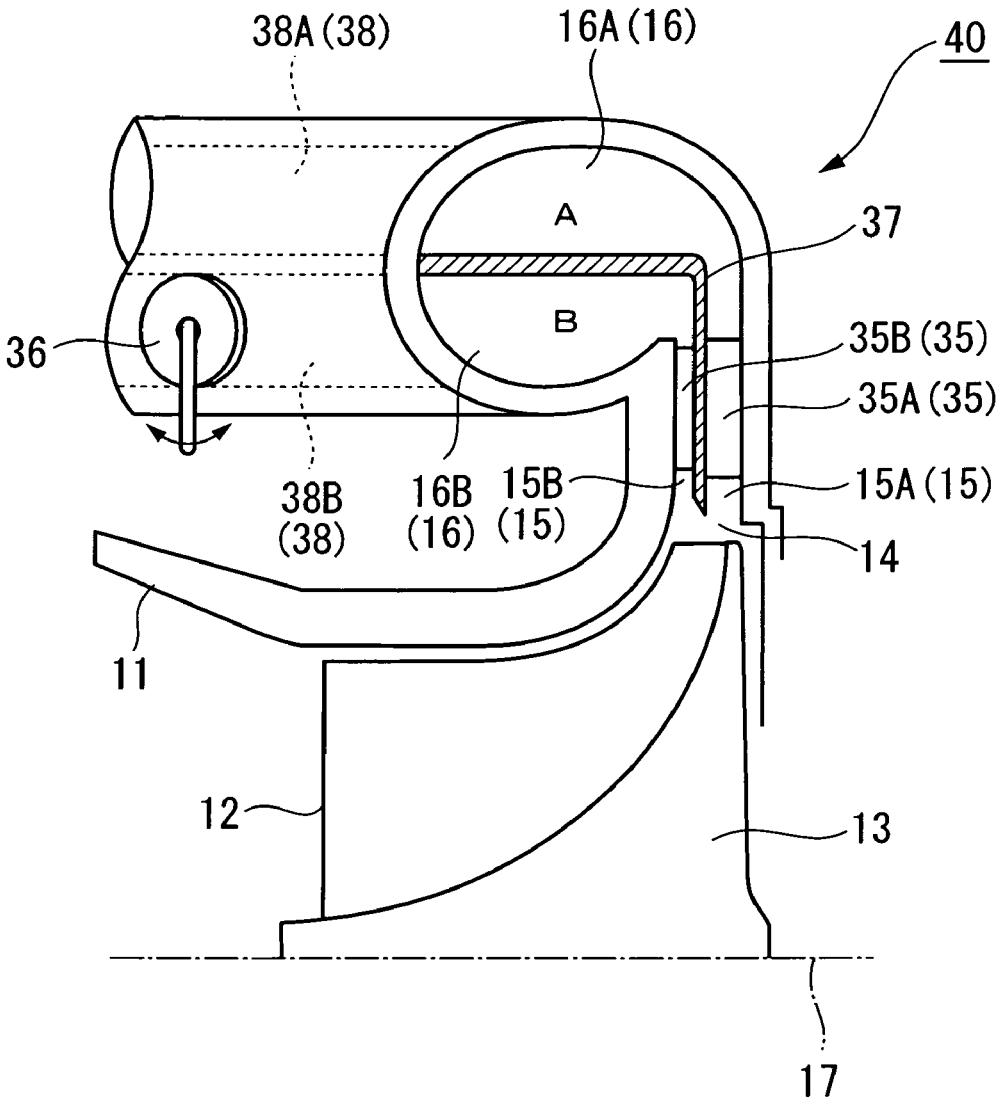
FIG. 7 is a vertical cross-sectional view of the centrifugal compressor according to a second embodiment of the invention.

Referring now to FIG. 7, a second embodiment of the invention will be described.

A centrifugal compressor in the second embodiment is different from that in the first embodiment in that the vanes are provided both on the hub-side diffuser section 15A and the shroud-side diffuser section 15B. The centrifugal compressor in the second embodiment will be described mainly on the different point from the first embodiment, while omitting description of the points which are common to the first embodiment.

As shown in FIG. 7, the hub-side diffuser section 15A and the shroud-side diffuser section 15B are provided with the vanes 35. The vanes 35 are arranged circumferentially at predetermined distances and are fixed to the casing 11.

The number of vanes 35A installed on the hub-side diffuser section 15A is larger than the number of vanes 35B installed on the shroud-side diffuser section 15B. Accordingly, the cross-sectional area of the flow channel of the hub-side diffuser section 15A is smaller than the cross-sectional area of the flow channel of the shroud-side diffuser section 15B. It is also possible to set the vane height or the vane angle of the vanes 35A installed on the hub-side diffuser section 15A smaller than the vane 35B installed on the shroud-side diffuser section 15B. Accordingly, the cross-sectional area of the flow channel of the hub-side diffuser section 15A may be set to be smaller than the cross-sectional area of the flow channel of the shroud-side diffuser section 15B as in the case described above.

The flow rate adjusting valve (flow rate adjuster) 36 for adjusting the flow rates in the respective flow channels is provided in the shroud-side exit tube 38B.

In the centrifugal compressor 40 having the configuration as described above, the flow rates in the respective flow channels are adjusted by operating the flow rate adjusting valve 36.

Figure 8A:
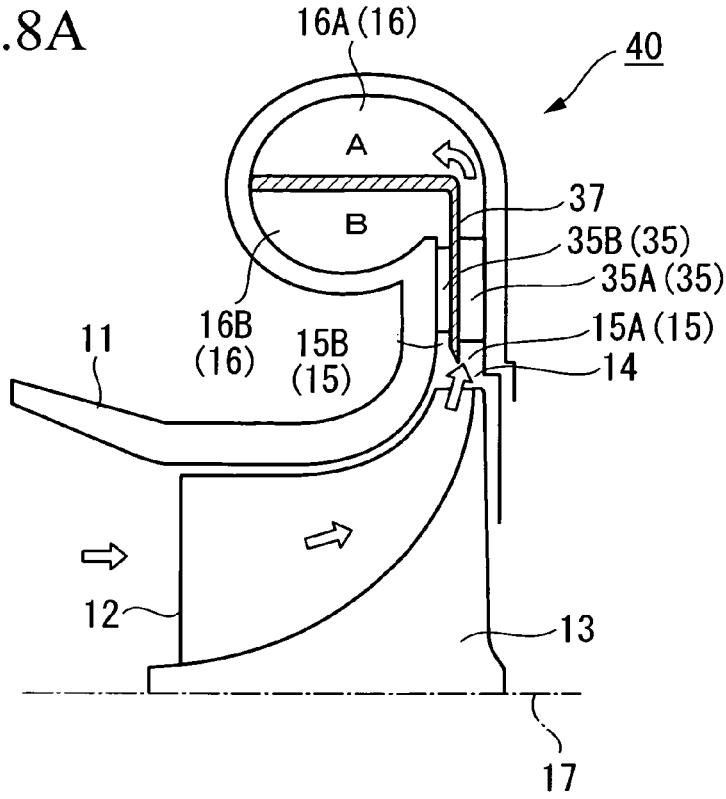
FIG. 8A is a vertical cross-sectional view showing a flowing state of the fluid when the flow rate is low according to the centrifugal compressor shown in FIG. 7.

When the flow rate of the fluid compressed by the impeller 13 is low, the opening of the flow rate adjusting valve 36 is narrowed to lower the flow rate of the fluid flowing into the shroud-side flow channel B as shown in FIG. 8A, so that the fluid flows in the hub-side flow channel A at a high flow rate. In other words, the compressed fluid circulates through the diffuser section inlet 14, the diffuser section 15A with a flow channel having a smaller cross-sectional area, and the volute section 16A in this order.

Figure 8B:
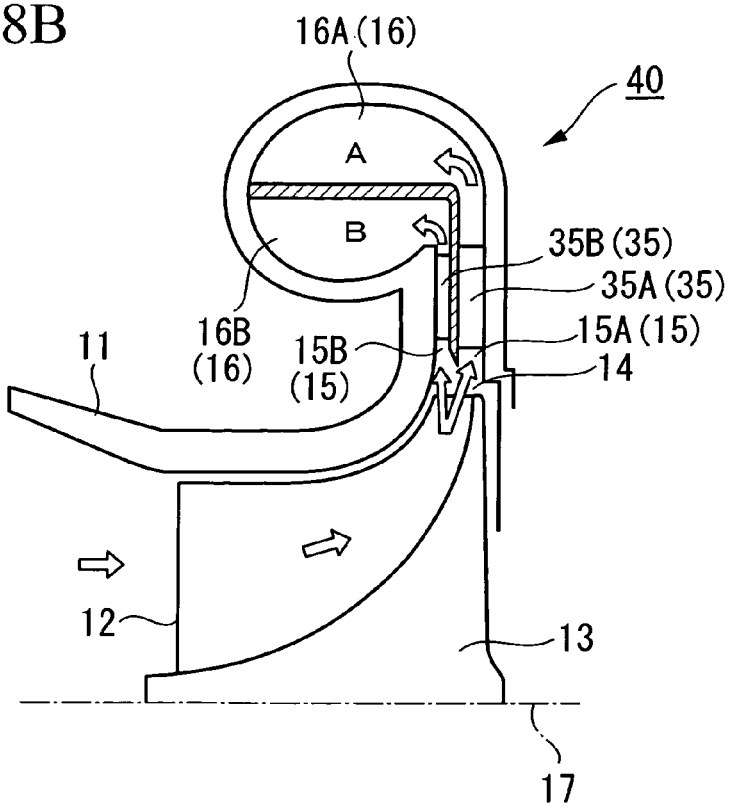
FIG. 8B is a vertical cross-sectional view showing a flowing state when the flow rate is high in the centrifugal compressor shown in FIG. 7.

In contrast, when the flow rate of the fluid compressed by the impeller 13 is high, the opening of the flow rate adjusting valve 36 is increased to allow the fluid to flow both in the shroud-side flow channel B and the hub-side flow channel A without lowering the flow rate of the fluid flowing in the shroud-side flow channel B as shown in FIG. 8B. In other words, the compressed fluid is branched at the diffuser section inlet 14, and circulates in the flow channel from the diffuser section 15A with the flow channel having a smaller cross-sectional area to the volute section 16A and the flow channel from the diffuser section 15B with a flow channel having a larger cross-sectional area to the volute section 16B.

Figure 9:
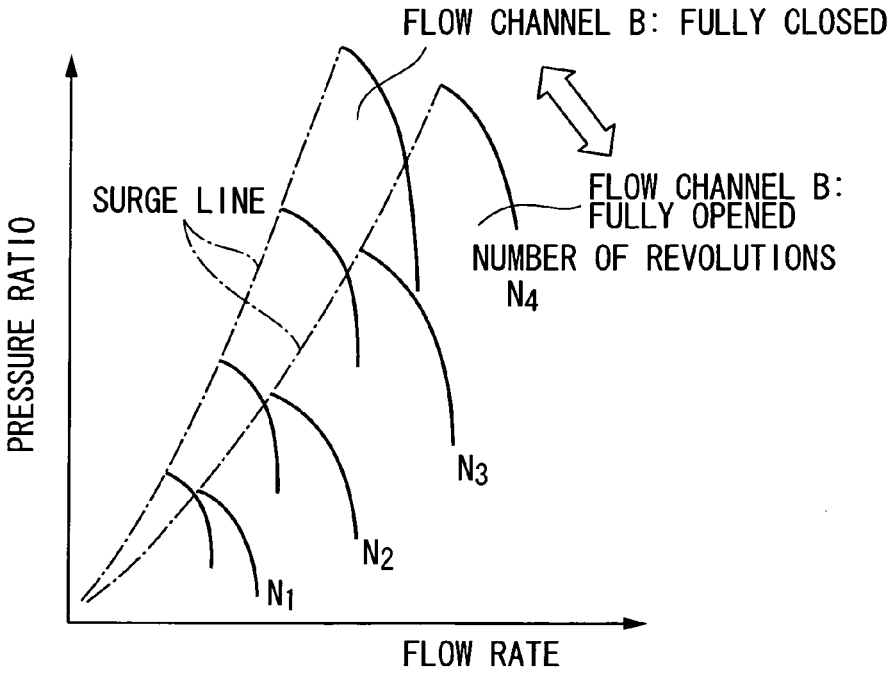
FIG. 9 is a graph showing the relation between the pressure ratio and the flow rate in the centrifugal compressor shown in FIG. 7.

FIG. 9 shows the relation between the flow rate and the pressure ratio of the centrifugal compressor according to the second embodiment.

As is understood from FIG. 9, a high pressure ratio is achieved by lowering the flow rate of the fluid flowing in the shroud-side flow channel B and allowing the fluid to flow in the hub-side flow channel A at a high flow rate when the flow rate of the compressed fluid is low. It is also understood that when the flow rate of the compressed fluid is high, a high pressure ratio is secured while increasing the range of the allowable flow rate by allowing the fluid to flow in the shroud-side flow channel B and the hub-side flow channel A without lowering the flow rate of the fluid flowing in the shroud-side flow channel B.

As described above, according to the centrifugal compressor in the second embodiment, the range of the flow rate can be widened while securing a high pressure ratio at a low cost in comparison with an inlet variable guiding wing or the variable diffuser which requires a complicated drive mechanism.

In the description of the second embodiment, the cross-sectional are of the flow channel of the hub-side diffuser section 15A is set to be smaller than the cross-sectional area of the shroud-side diffuser section 15B. However, it is also possible to set the cross-sectional area of the flow channel of the hub-side diffuser section 15A to be larger than the cross-sectional area of the flow channel of the shroud-side diffuser section 15B. In this configuration as well, widening of the operating range of the centrifugal compressor is achieved.

Third Embodiment

Figure 10:
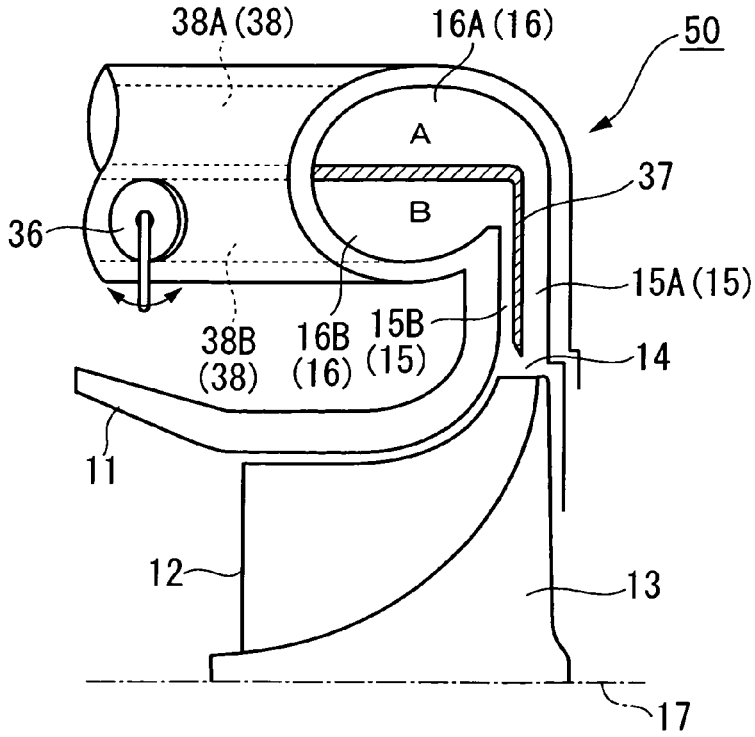
FIG. 10 is a vertical cross-sectional view of the centrifugal compressor according to a third embodiment of the invention.

Referring now to FIG. 10, a third embodiment of the invention will be described.

A centrifugal compressor in the third embodiment is different from that in the embodiments shown above in that the vane is provided neither on the hub-side diffuser section 15A nor the shroud-side diffuser section 15B. The centrifugal compressor in the third embodiment will be described mainly on the different point from the embodiments shown above, while omitting description of the points which are common to the embodiments shown above.

As shown in FIG. 10, the hub-side diffuser section 15A and the shroud-side diffuser section 15B are not provided with the vane. The cross-sectional area of the flow channel of the hub-side diffuser section 15A is set to be smaller than the cross-sectional area of the flow channel of the shroud-side diffuser section 15B.

The flow rate adjusting valve (flow rate adjuster) 36 for adjusting the flow rates in the respective flow channels is provided in the shroud-side exit tube 38B.

In a centrifugal compressor 50 having the configuration as described above, the flow rates in the respective flow channels are adjusted by operating the flow rate adjusting valve 36.

Figure 11A:
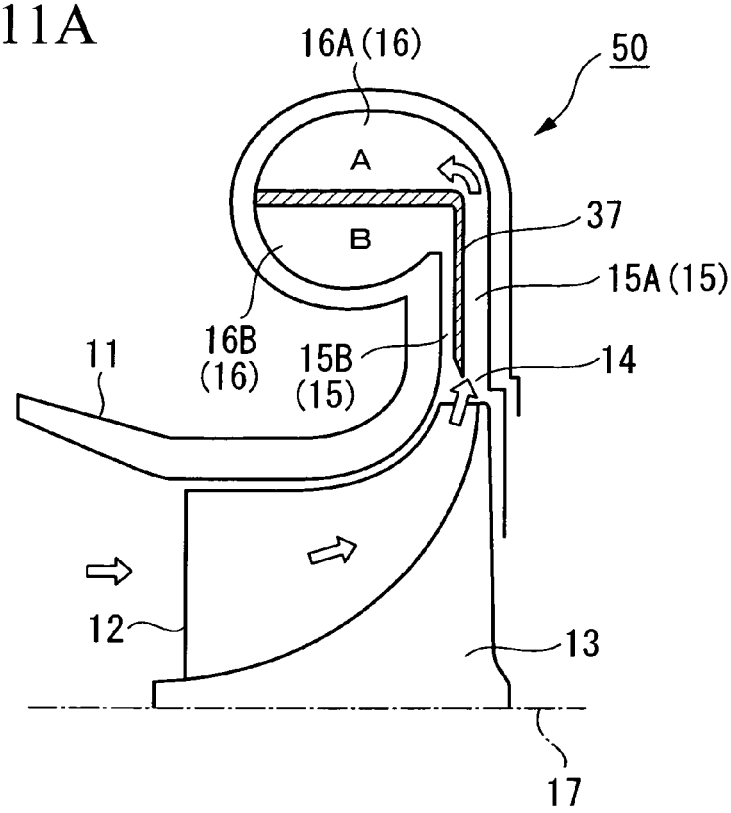
FIG. 11A is a vertical cross-sectional view showing a flowing state of the fluid when the flow rate is low in the centrifugal compressor shown in FIG. 10.

When the flow rate of the fluid compressed by the impeller 13 is low, the opening of the flow rate adjusting valve 36 is narrowed to lower the flow rate of the fluid flowing into the shroud-side flow channel B as shown in FIG. 11A, so that the fluid flows in the hub-side flow channel A at a high flow rate. In other words, the compressed fluid circulates through the diffuser section inlet 14, the diffuser section 15A with the flow channel having a smaller cross-sectional area, and the volute section 16A in this order.

Figure 11B:
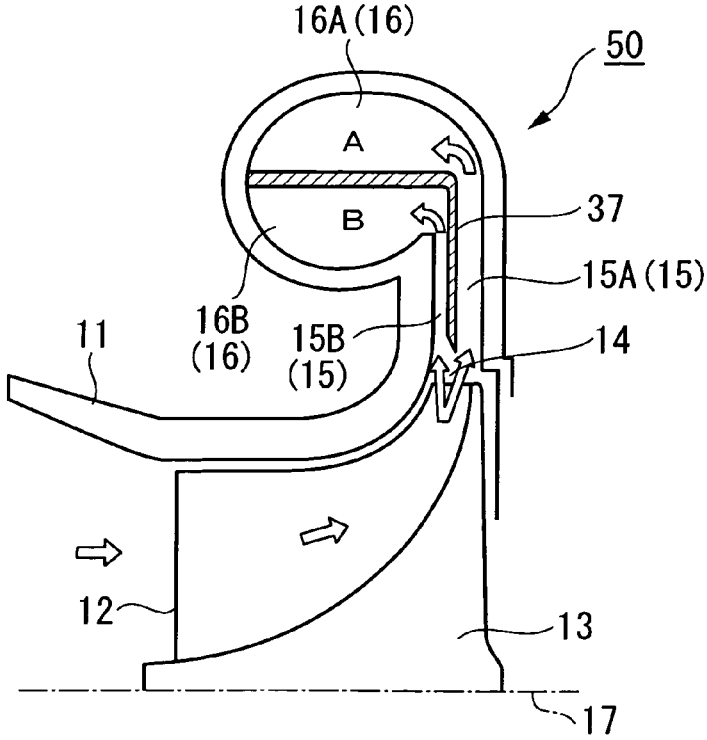
FIG. 11B is a vertical cross-sectional view showing a flowing state of the fluid when the flow rate is high in the centrifugal compressor shown in FIG. 10.

In contrast, when the flow rate of the fluid compressed by the impeller 13 is high, the opening of the flow rate adjusting valve 36 is increased to allow the fluid to flow in the shroud-side flow channel B and the hub-side flow channel A without lowering the flow rate of the fluid flowing in the shroud-side flow channel B as shown in FIG. 11B. In other words, the compressed fluid is branched at the diffuser section inlet 14, and circulates in the flow channel from the diffuser section 15A with the flow channel having a smaller cross-sectional area to the hub-side volute section 16A and the flow channel from the diffuser section 15B with the flow channel having a larger cross-sectional area to the volute section 16B.

Figure 12:
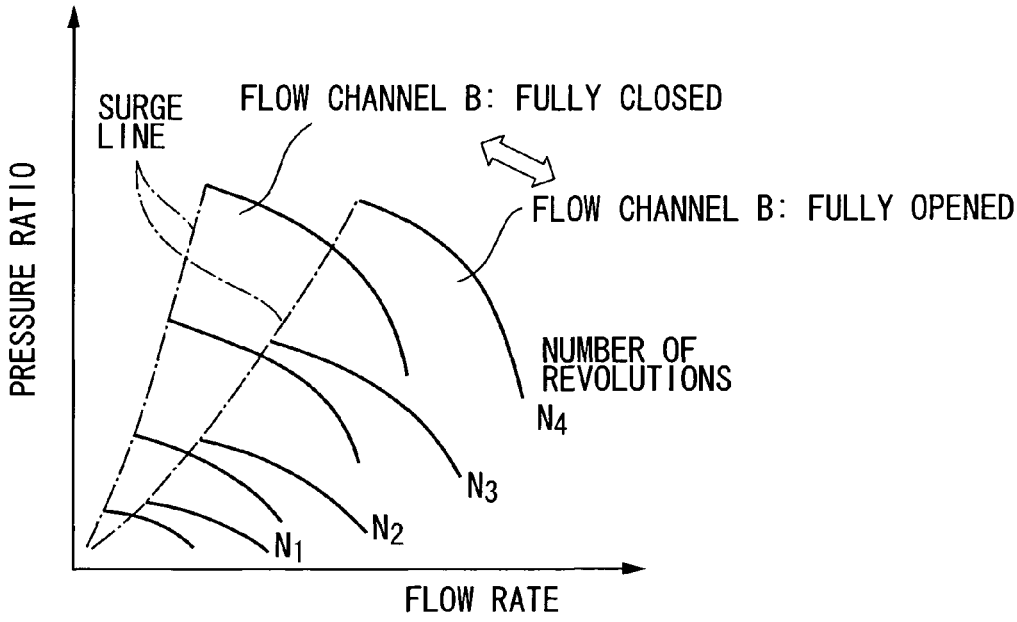
FIG. 12 is a graph showing the relation between the pressure ratio and the flow rate in the centrifugal compressor shown in FIG. 10.
Figure 13:
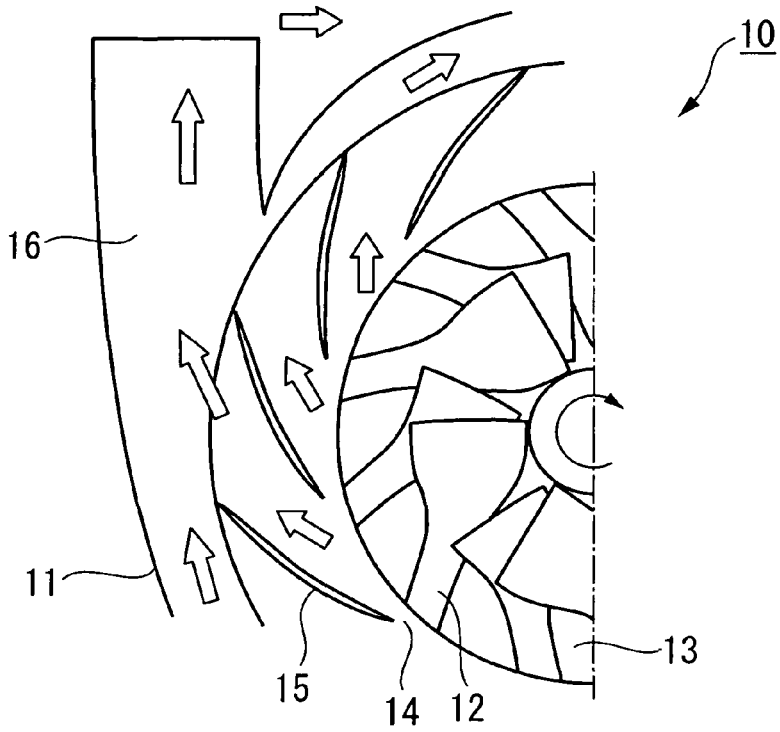
FIG. 13 is a front view showing a principal portion of a centrifugal compressor in the related art.
Figure 14:
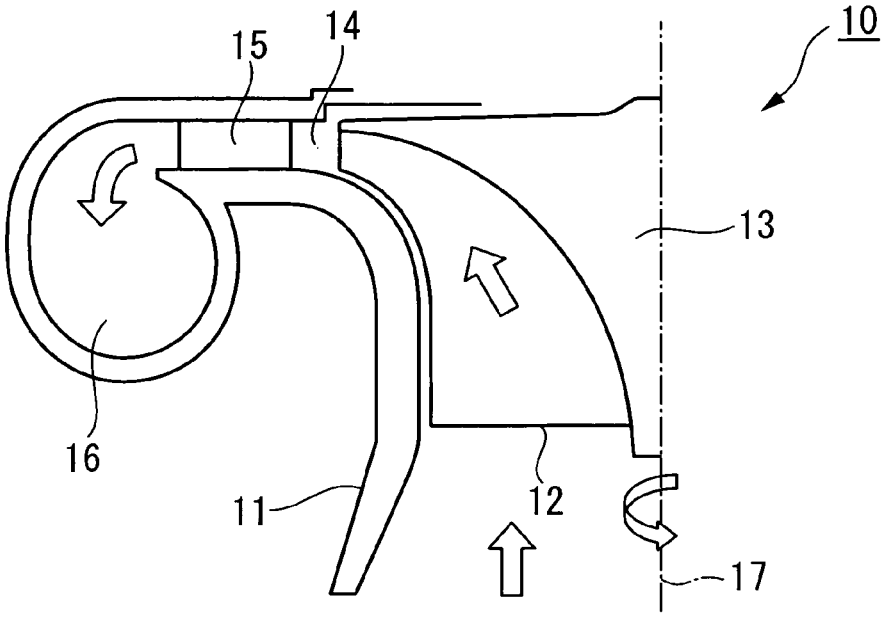
FIG. 14 is a vertical cross-sectional view of the centrifugal compressor in the related art.
Figure 15:
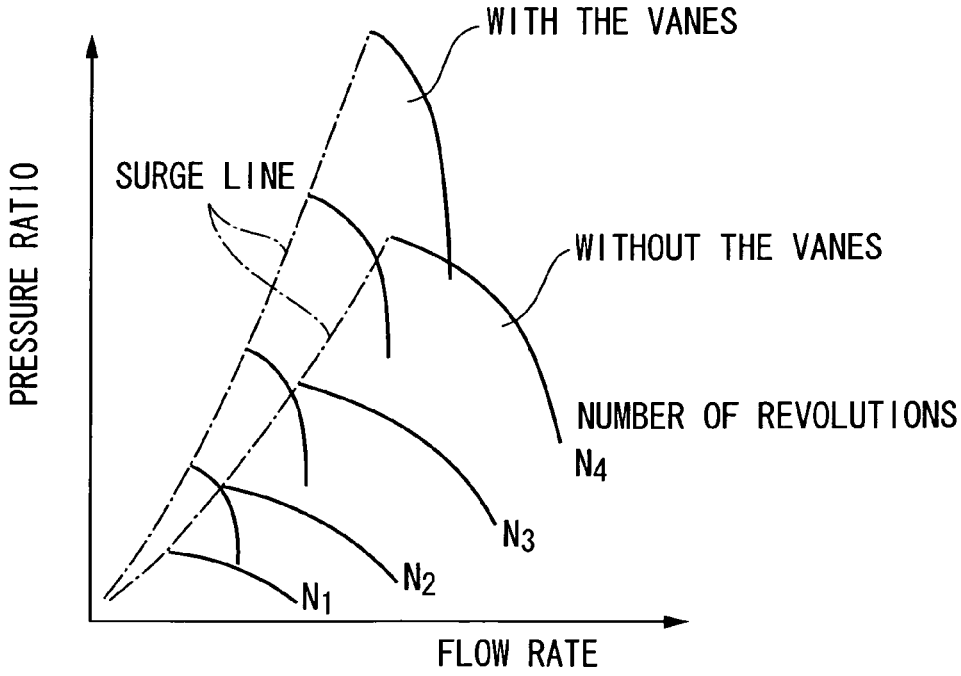
FIG. 15 is a graph showing the relation between the pressure ratio and the flow rate in the centrifugal compressor in the related art.
Figure 16:
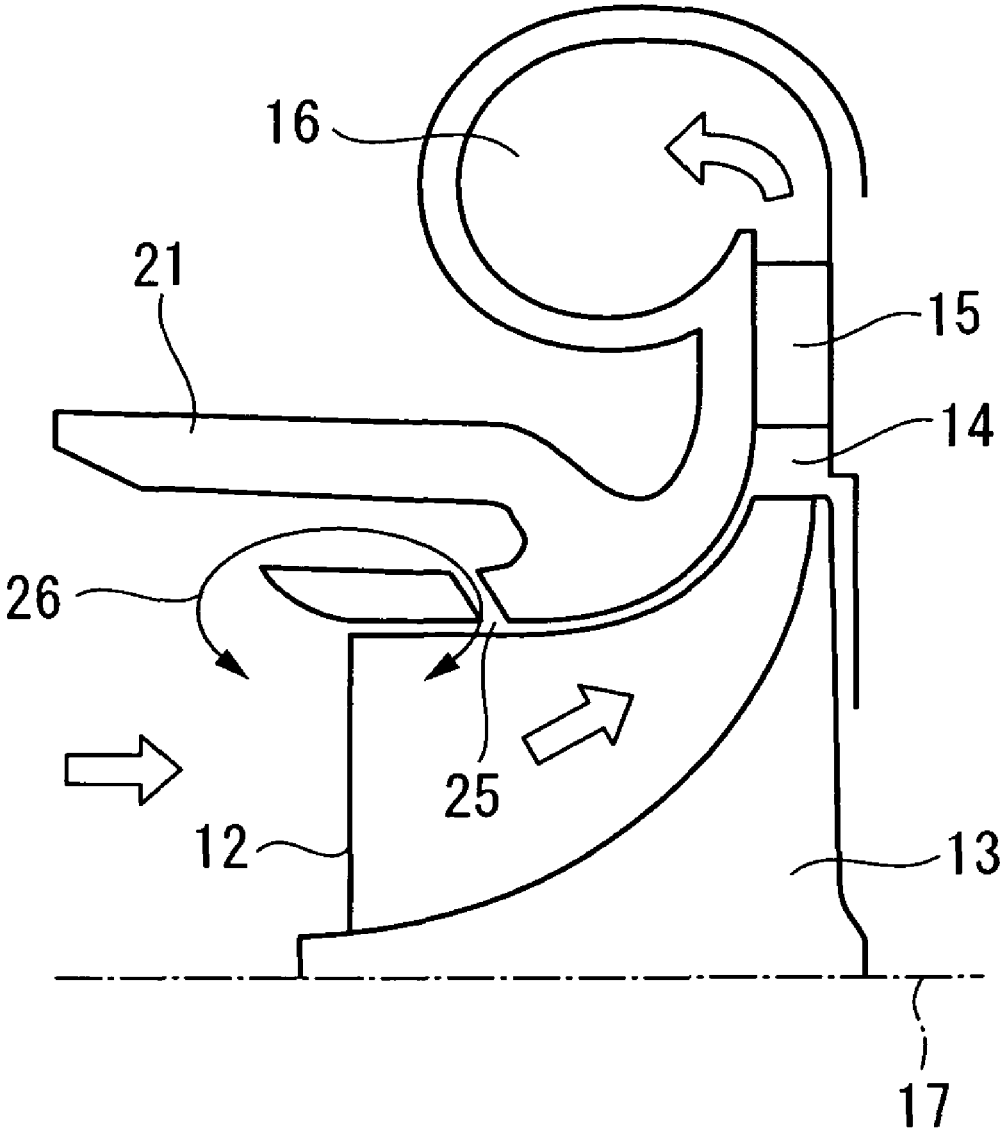
FIG. 16 is a vertical cross-sectional view of the centrifugal compressor in the related art.
Figure 17A:
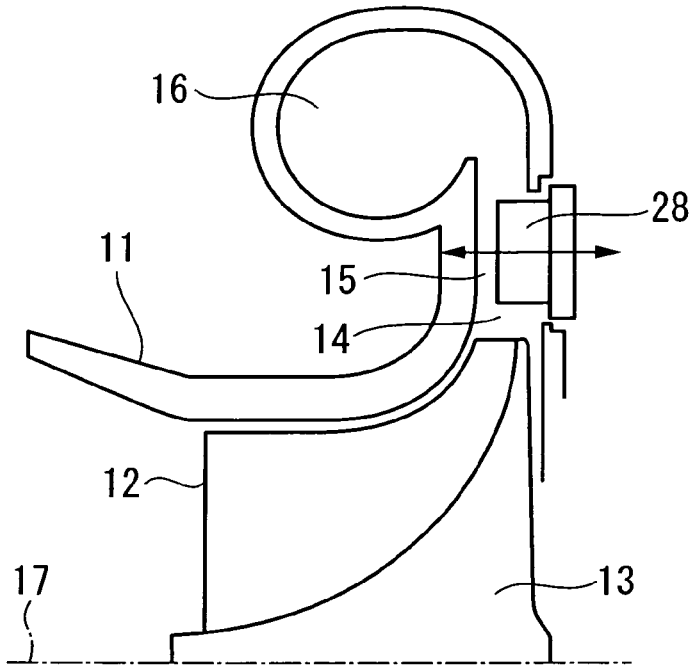
FIG. 17A is a vertical cross-sectional view of the centrifugal compressor in the related art.
Figure 17B:
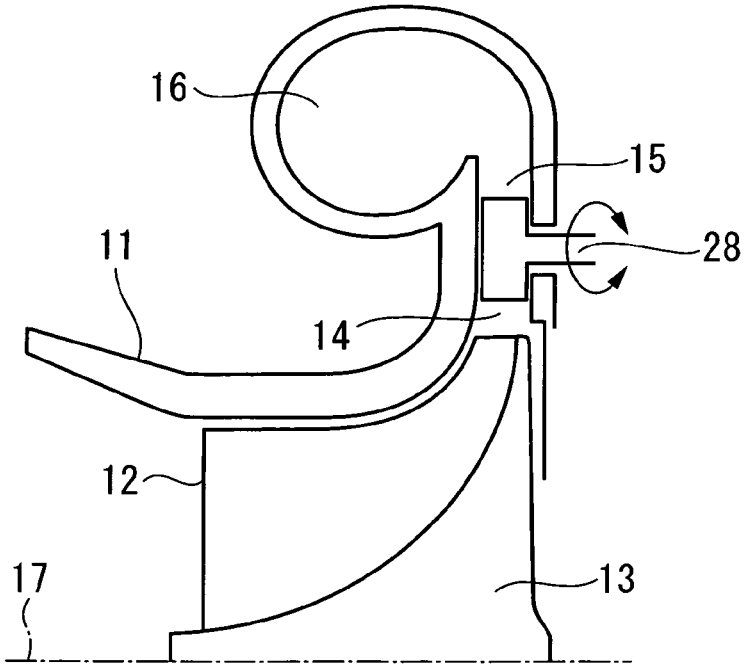
FIG. 17B is a vertical cross-sectional view of the centrifugal compressor in the related art.
Figure 18:
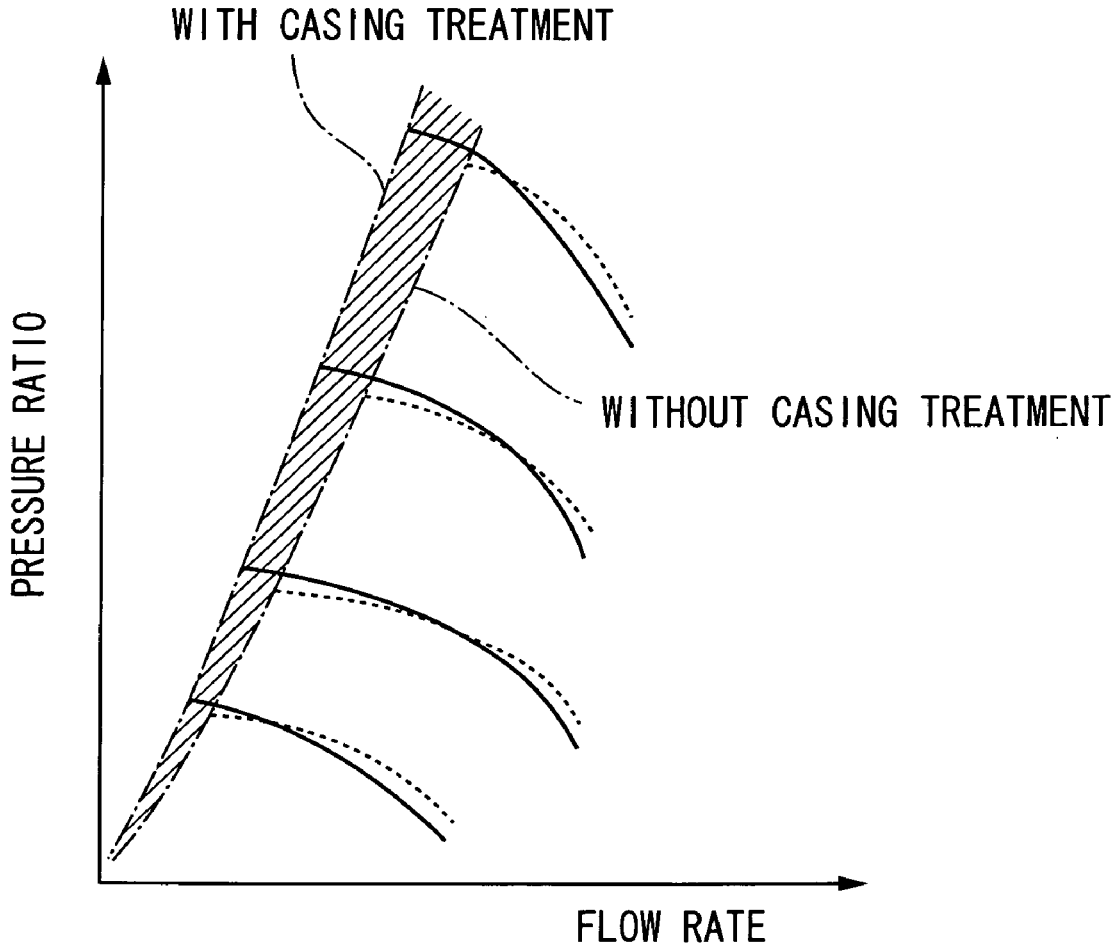
FIG. 18 is a graph showing the relation between the pressure ratio and the flow rate in the centrifugal compressor in the related art.

FIG. 12 shows the relation between the flow rate and the pressure ratio of the centrifugal compressor according to the third embodiment.

As is understood from FIG. 12, a high pressure ratio is achieved by lowering the flow rate of the fluid flowing in the shroud-side flow channel B and allowing the fluid to flow in the hub-side flow channel A at a high flow rate when the flow rate of the compressed fluid is low. It is also understood that when the flow rate of the compressed fluid is high, the flow rate rage which can be accommodated is increased by allowing the fluid to flow in the shroud-side flow channel B and the hub-side flow channel A without lowering the flow rate of the fluid flowing in the shroud-side flow channel B.

As described above, according to the centrifugal compressor in the third embodiment, widening of the operating range is enabled in comparison with the inlet variable guiding wing or the variable diffuser which requires a complicated drive mechanism. Since the wing is not provided in both flow channels, it is economically efficient in comparison with the embodiments shown above.

In the description of the third embodiment, the cross-sectional are of the flow channel of the hub-side diffuser section 15A is set to be smaller than the cross-sectional area of the shroud-side diffuser section 15B. However, it is also possible to set the cross-sectional area of the flow channel of the hub-side diffuser section 15A to be larger than the cross-sectional area of the flow channel of the shroud-side diffuser section 15B. In this configuration as well, widening of the operating range of the centrifugal compressor is achieved.

The invention claimed is:

1. A centrifugal compressor comprising:

a revolving shaft;

an impeller mounted to the revolving shaft;

a casing configured to house the impeller;

a diffuser section connected downstream of the impeller; and a volute section connected downstream of the diffuser section, and being configured to compress fluid by applying a centrifugal force to the fluid by rotating the impeller;

a parting member configured to divide a flow channel in the diffuser section and the volute section into a plurality of channels in a direction of circulation of the fluid so as to define a hub-side flow channel and a shroud-side flow channel; and a flow rate adjuster configured to lower the flow rate of the fluid flowing in the shroud-side flow channel and enabling the fluid to flow in the hub-side flow channel at a high flow rate when the flow rate of the fluid compressed by the impeller is low and not lowering the flow rate of the fluid flowing the shroud-side flow channel to enable the fluid to flow both in the shroud-side flow channel and the hub-side flow channel when the flow rate of the fluid compressed by the impeller is high, wherein the diffuser section includes a hub-side diffuser section in the hub-side flow channel and a shroud-side diffuser section in the shroud-side flow channel, at least the hub-side diffuser section is provided with vanes, and a cross-sectional area of the flow channel in the shroud-side diffuser section is larger than the cross-sectional area of the flow channel in the hub-side diffuser section.

2. The centrifugal compressor according to claim 1, wherein the parting member is a partition wall disposed in the interiors of the diffuser section and the volute section.

3. The centrifugal compressor according to claim 1, wherein the flow rate adjuster is a flow rate adjusting valve disposed in the vicinity of an exit portion of the volute section.

4. The centrifugal compressor according to claim 1, wherein the diameter of an inlet for at least one of the hub-side diffuser section and the shroud-side diffuser section is 1.02 to 1.2 times the diameter of the impeller.

5. The centrifugal compressor according to claim 2, wherein an end surface of the partition wall on an upstream side is inclined from a hub side to a shroud side.

6. The centrifugal compressor according to claim 1, wherein the shroud-side diffuser section includes vanes, and a number of the vanes on the hub-side diffuser section is larger than a number of the vanes on the shroud-side diffuser section.

7. The centrifugal compressor according to claim 6, wherein a vane height or a vane angle of the vanes in the hub-side diffuser section is smaller than a van height or a vane angle of the vanes in the shroud-side diffuser section.

* * * * *